US009627736B1

(12) United States Patent
Ingalls

(10) Patent No.: US 9,627,736 B1
(45) Date of Patent: Apr. 18, 2017

(54) MULTI-LAYER MICROWAVE CROSSOVER CONNECTED BY VERTICAL VIAS HAVING PARTIAL ARC SHAPES

(71) Applicant: Mark W. Ingalls, Fayetteville, AR (US)

(72) Inventor: Mark W. Ingalls, Fayetteville, AR (US)

( * ) Notice: Subject to any disclaimer, the term of this patent is extended or adjusted under 35 U.S.C. 154(b) by 0 days.

(21) Appl. No.: 14/516,829

(22) Filed: Oct. 17, 2014

(51) Int. Cl.
*H01P 3/08* (2006.01)
*H01P 5/02* (2006.01)
*H01P 3/00* (2006.01)

(52) U.S. Cl.
CPC ..... *H01P 3/088* (2013.01); *H01P 3/006* (2013.01); *H01P 5/02* (2013.01)

(58) Field of Classification Search
CPC ..... H01P 3/003; H01P 3/006; H01P 3/088
USPC ..... 333/1, 246
See application file for complete search history.

(56) References Cited

U.S. PATENT DOCUMENTS 2,860,305 A 11/1958 Bey et al. ..... 324/68
2,926,317 A * 2/1960 Blitz ..... H01P 3/085 333/238
3,104,363 A 9/1963 Butler ..... 333/84
3,740,678 A 6/1973 Hill ..... 333/84
4,078,214 A 3/1978 Beno ..... 333/7
4,533,883 A 8/1985 Hudspeth et al. ..... 333/1
4,675,620 A * 6/1987 Fullerton ..... H01P 3/003 333/1
5,003,273 A 3/1991 Oppenberg ..... 333/1
5,321,375 A 6/1994 Corman ..... 333/246
5,334,800 A * 8/1994 Kenney ..... H05K 1/0224 174/250
5,600,285 A 2/1997 Sachs et al. ..... 333/1
6,097,260 A 8/2000 Whybrew et al. ..... 333/1
6,522,214 B1 * 2/2003 Harju ..... H01P 1/047 333/1
6,734,750 B1 5/2004 Ostergaard ..... 333/1
6,825,749 B1 11/2004 Lin et al. ..... 336/200
7,842,886 B2 * 11/2010 Kobayashi ..... H01P 3/003 174/117 F
2014/0292450 A1 * 10/2014 Kato ..... H01P 3/003 333/238

* cited by examiner

*Primary Examiner* — Benny Lee
(74) *Attorney, Agent, or Firm* — Keisling & Pieper PLC; David B. Pieper

(57) ABSTRACT

A microwave frequency signal path crossover apparatus for surface mounting to a circuit board. The signal path crossover including interspaced planar horizontal shielding members, horizontal dielectric members, and vertical shielding vias surrounding horizontal signal carrying members connected to the circuit board by vertical vias. Low errant signal emitting structures including partial half and three quarter arc vias, terminating arms, half circle arc transition apertures, via grounding fingers, and compensating capacitive structures are taught.

9 Claims, 7 Drawing Sheets

MULTI-LAYER MICROWAVE CROSSOVER CONNECTED BY VERTICAL VIAS HAVING PARTIAL ARC SHAPES

CROSS-REFERENCE TO RELATED APPLICATIONS

This application claims priority to and is a continuation-in-part of U.S. provisional application Ser. No. 61/894,663 filed on Oct. 23, 2013. This application is hereby expressly incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in surface mount components for electrical circuits handling microwave frequencies with signal paths that cross in proximity each other. More particularly, the invention relates to improvements particularly suited for multiple layer circuits requiring high signal quality and low profile applications. In particular, the present invention relates specifically to a particular surface mount construction of a crossover apparatus and method minimizing disruptions to the electrical signals.

2. Description of the Known Art

As will be appreciated by those skilled in the art, signal path crossings or crossovers are known in various forms. Patents disclosing information relevant to signal path crossovers include: U.S. Pat. No. 2,860,305, issued to Bey on Nov. 11, 1958 entitled High frequency transmission line coupling device; U.S. Pat. No. 3,104,363, issued to Butler on Sep. 17, 1963 entitled Strip transmission line crossover having reduced impedance discontinuity; U.S. Pat. No. 3,740,678, issued to Hill on Jun. 19, 1973 entitled Strip Transmission Line Structures; U.S. Pat. No. 4,078,214, issued to Beno on Mar. 7, 1978 entitled Microwave crossover switch; U.S. Pat. No. 4,533,883, issued to Hudspeth, et al. on Aug. 6, 1985 entitled Coaxial transmission line crossing; U.S. Pat. No. 5,003,273, issued to Oppenberg on Mar. 26, 1991 entitled Multilayer printed circuit board with pseudo-coaxial transmission lines; U.S. Pat. No. 5,321,375, issued to Corman on Jun. 14, 1994 entitled RF crossover network; U.S. Pat. No. 5,600,285, issued to Sachs, et al. on Feb. 4, 1997 entitled Monolithic stripline crossover coupler having a pyramidal grounding structure; U.S. Pat. No. 6,097,260 issued to Whybrew, et al. on Aug. 1, 2000 entitled Distributed ground pads for shielding cross-overs of mutually overlapping stripline signal transmission networks; U.S. Pat. No. 6,734,750, issued to Ostergaard on May 11, 2004 entitled Surface mount crossover component; U.S. Pat. No. 6,825,749, issued to Lin, et al. on Nov. 30, 2004 entitled Symmetric crossover structure of two lines for RF integrated circuits. Each of these patents is hereby expressly incorporated by reference in their entirety.

These patents teach various structures for crossovers but fail to recognized a simple construction approach with integrated capacitors and a construction that eliminates excess unwanted signal paths. Thus, these prior references are very limited in their teaching and utilization, and an improved microwave crossover is needed to overcome these limitations.

SUMMARY OF THE INVENTION

The present invention is directed to an improved surface mount microwave crossover for a signal crossing location on an electric circuit board for high frequency lines operating with microwave type signals and frequencies. In accordance with one exemplary embodiment of the present invention, a method and construction is taught for a surface mount multiple layer build up of a three dimensional crossover. The three dimensional crossover utilizes a full triple ground plane sandwiching two different ground surrounded signal paths. A further improvement teaches built in compensating capacitance. Still further, the invention teaches minimization of the excess material to minimize stray signal effects. The invention has the advantage that it operates over a wide band of frequencies and is economical in construction costs. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 4:
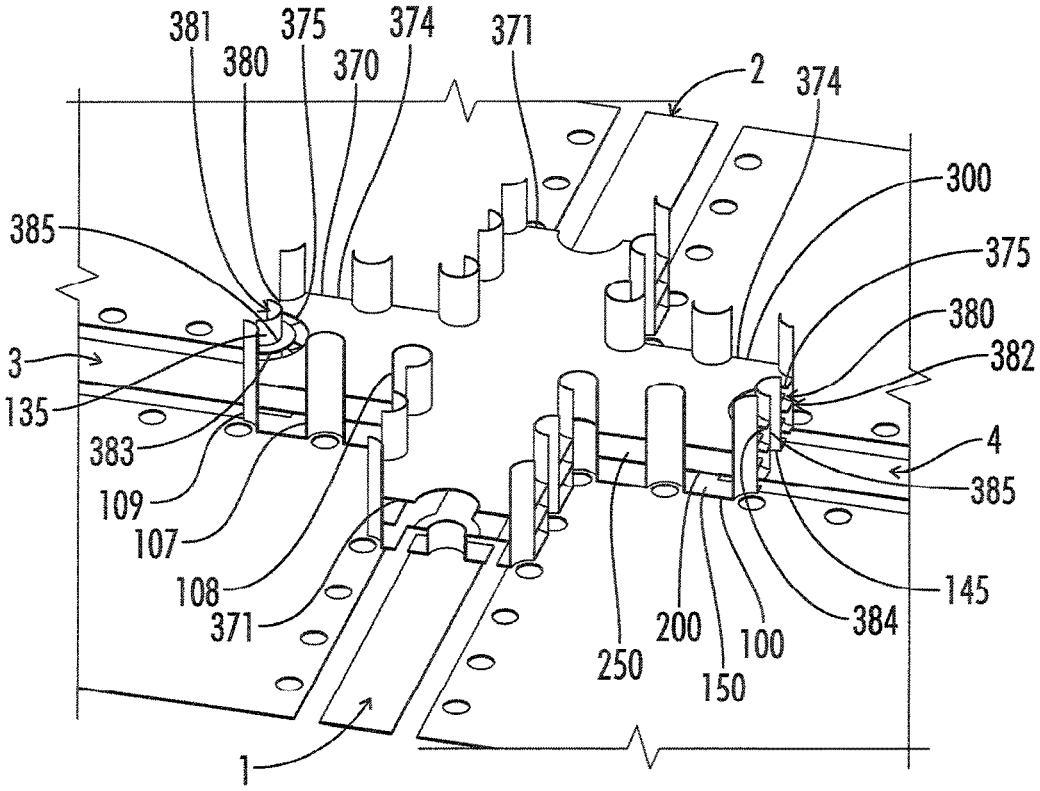
FIG. 4 shows the third metal layer with an uninterrupted ground plane and compensating capacitors.
Figure 5:
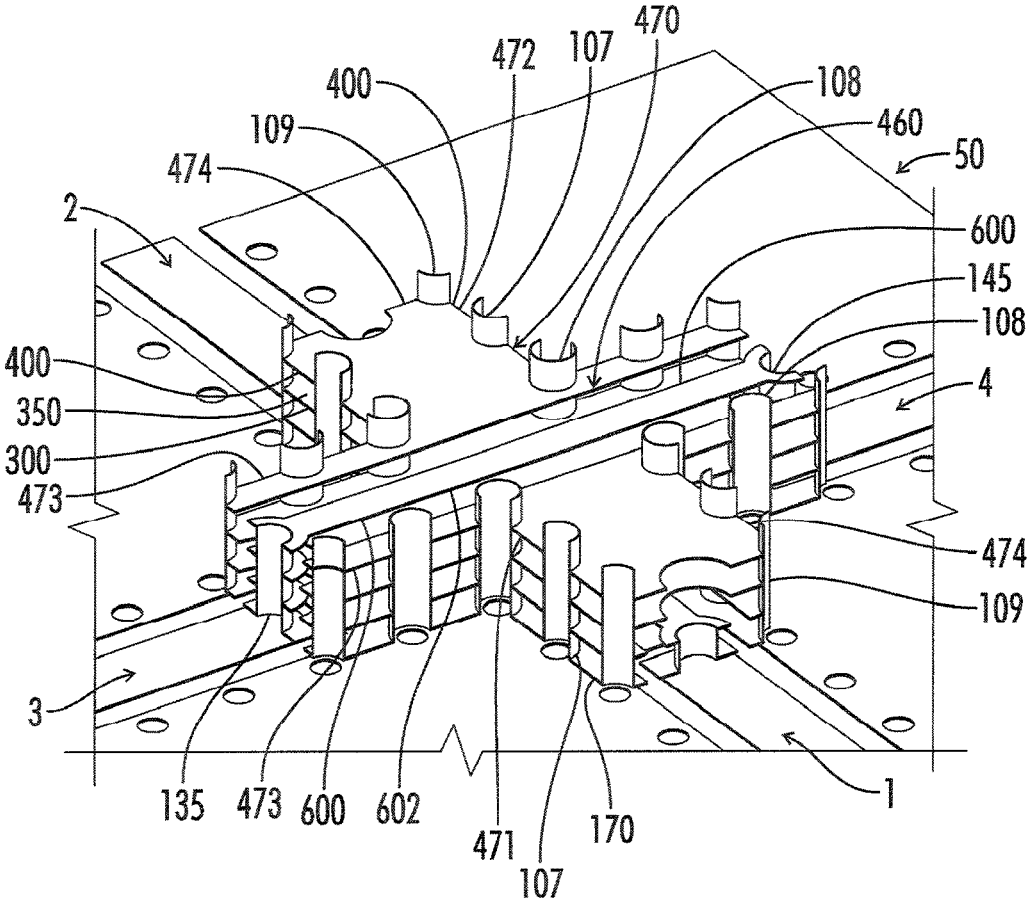
FIG. 5 shows the fifth metal layer in plane with the second conducting signal layer.
Figure 6:
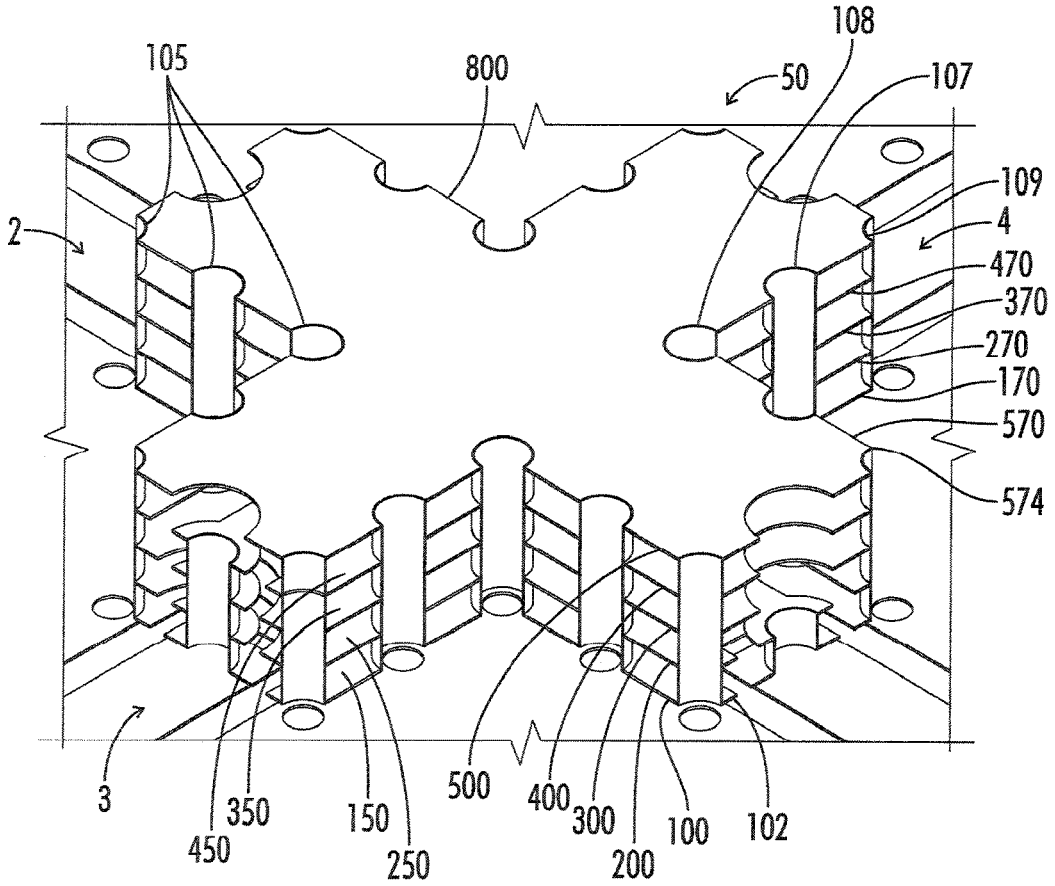
FIG. 6 shows the sixth metal layer.

As shown in the build up from FIG. 1 to FIG. 6 of the drawings and shown completed in FIG. 6, one exemplary embodiment of the present invention is generally shown as a microwave crossover 50 (in FIGS. 2, 5, and 6) for surface mounting on a circuit board 10. FIGS. 2 through 6 show the construction of the crossover 50 with a first conductive layer 100 (in FIGS. 2 through 4 and 6), first dielectric 150 (in FIGS. 3, 4, and 6), second conductive layer 200 (in FIGS. 3, 4, and 6), second dielectric 250 (FIGS. 4 and 6), third conductive layer 300 (FIGS. 4, 5 and 6), third dielectric 350 (in FIGS. 5 and 6), fourth conductive layer 400 (in FIGS. 5 and 6), fourth dielectric 450 (in FIG. 6), and fifth conductive layer 500 (in FIG. 6) connected by vertical vias 105 (in FIGS. 2 and 6). The layers 100, 200, 300, 400, 500 and dielectrics 150, 250, 350, 450 are planar and the conductive vias 105 are vertical. This construction forms shielded paths 600 (in FIGS. 3 and 5), a synthetic transmission line 700 (in FIG. 7), and a cutoff waveguide 800 (in FIG. 6). For the preferred embodiment, the conductive layers were formed from metal, but any substance with the appropriate shielding characteristics and electrical transmission characteristics may be utilized. We can consider each of the elements during the build up from the base circuit 10 (in FIG. 1).

Figure 1:
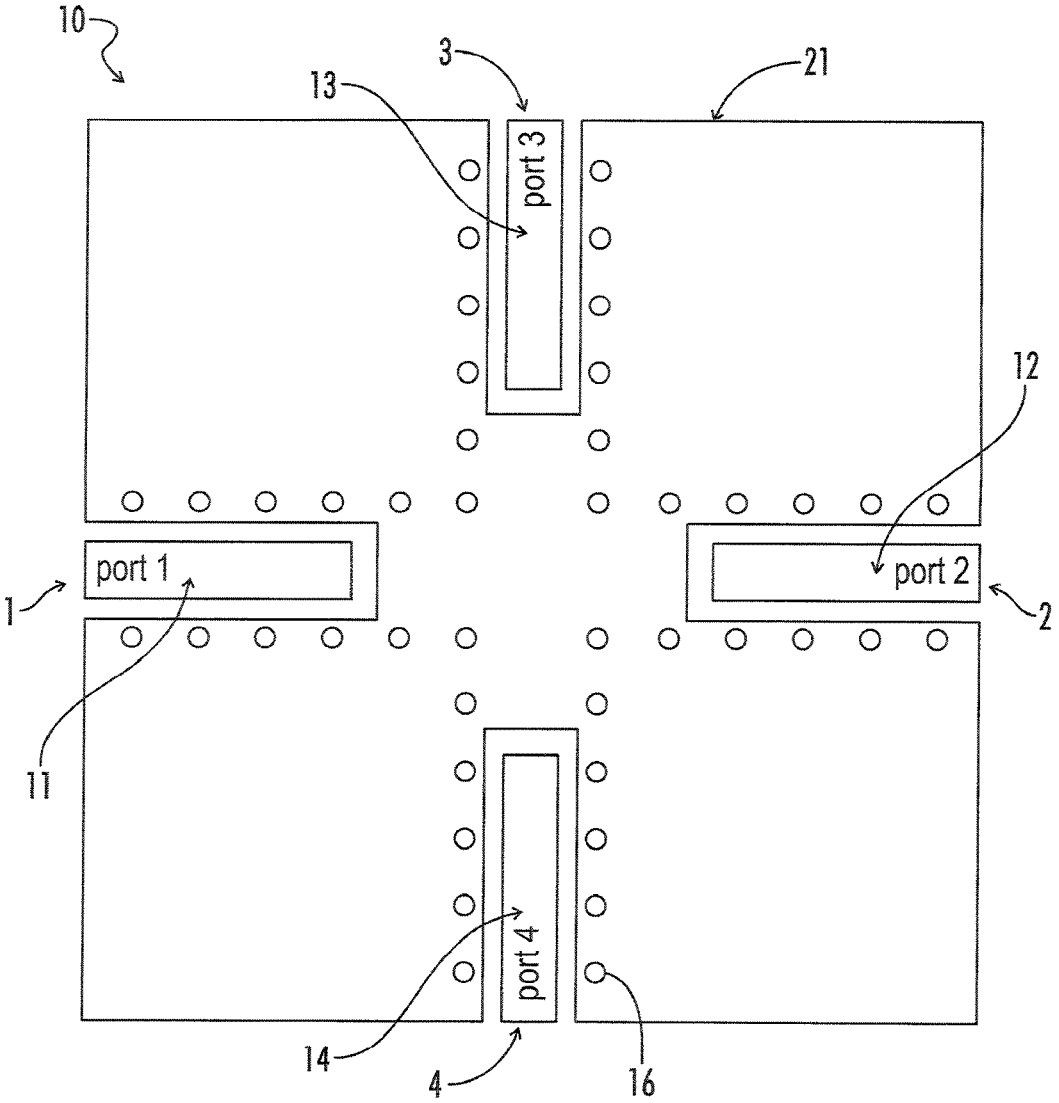
FIG. 1 provides a schematic view of a multiple port portion of a single layer microwave circuit.

FIG. 1 schematically depicts a multiple port portion of a single layer microwave circuit 10. The microwave circuit board 10 includes a first port 1 with a first signal line 11, a second port 2 with a second signal line 12, a third port 3 with a third signal line 13, and a fourth port 4 with a fourth signal line 14 embedded in a common ground plane 21. The common ground plane 21 and the term 'ground' are to be interpreted as the base potential for the signals in the operating environment for the microwave circuit board that may be considered to be ground in most operating circuits, but it is envisioned that 'ground' may take on the meaning of the 'base signal level' in some applications where true 'ground' is not used in the circuitry. The ground plane 21 may or may not be connected to a second ground plane on the underside of the circuit by plated through-holes, or vias 16.

Figure 2:
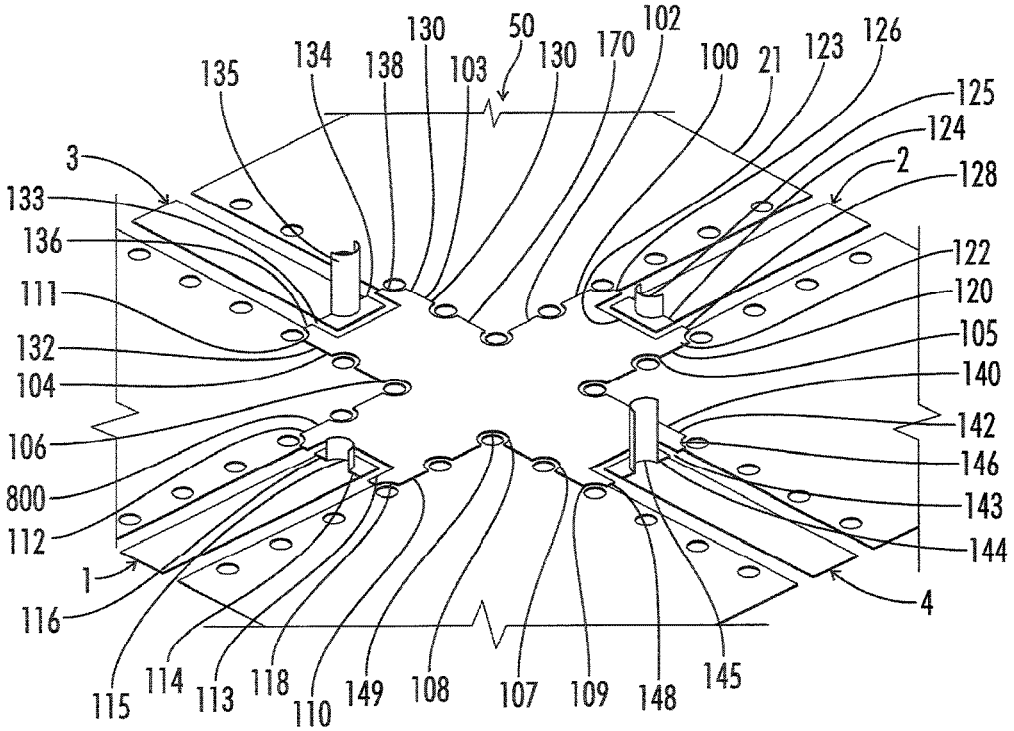
FIG. 2 shows the first metal layer for the crossover.

FIG. 2 shows the first conductive layer 100 electrically bonded and physically bonded to and enhancing the ground plane 21 inside the crossover 50 making the crossover 50 performance less susceptible to misalignment effects. As shown in FIG. 2 the bottom of the microwave crossover 50 is a first conductive layer 100 that is intended to mimic the direction of the required layout of the signal paths on the microwave circuit 10. Thus, the first conductive layer 100 serves two main functions: first a means for connecting the crossover 50 to the circuit board 21 via bonding or soldering, thus, both electrically and mechanically; and second the first conductive layer 100 minimizes the electrical effects, e.g. reflections of slight placement errors.

The first ground conductive layer 100 is designed with body 102 forming a ground plane 170 having a perimeter 103 defining arm edges 104 and corners 106, 111. Note the symmetric perpendicular cross shape 800 of the first conductive layer 100 with the initial formation of vertical vias 105 on the perimeter 103. The vertical vias 105 can be simple wires but the preferred embodiment uses half arc vias 107 on the arm edges 104 and three quarter vias 108 on the inner corners 106, and one quarter vias 109 on the outer corners 111. The vertical vias are also shown positioned to electrically connect to the board ground plane 21. The partial arc shape of the preferred vertical vias 107, 108, 109 is important for the efficient operation of the crossover 50 because the shape minimizes the effect of interference and stray signals. The body 102 is constructed with a first arm 110, a second arm 120, a third arm 130, and a fourth arm 140 with each arm 110, 120, 130, 140 connected to the center body 149. The first arm 110 includes a first transition end 112 designed with a first via transfer 114 positioned in a first rectangular cutout transition aperture 113 between the first ground fingers 116, 118. The first via transfer 114 supports the first signal via 115. The second arm 120 includes a second transition end 122 designed with a second via transfer 124 positioned in a second rectangular cutout transition aperture 123 between the second ground fingers 126, 128. The second via transfer 124 support the second signal via 125. The third arm 130 includes a third transition end 132 designed with a third via transfer 134 positioned in a third rectangular cutout transition aperture 133 between the third ground fingers 136, 138. The third via transfer 134 supports the third signal via 135. The fourth arm 140 includes a fourth transition end 142 designed with a fourth via transfer 144 positioned in a fourth rectangular cutout transition aperture 143 between the fourth ground fingers 146, 148. The fourth via transfer 144 supports the fourth signal via 145.

The four signal vias 115, 125, 135, 145 are used to create two separate signal paths with the first path 601 in (in FIG. 3) from port 1 to port 2 and the separate second path 602 (in FIG. 5) from port 3 to port 4. As a reference point, the shorter first via 115 in the lower left of center is electrically connected to port 1, the shorter second via 125 in the upper right is electrically connected to port 2, the longer third via 135 in the upper left is electrically connected to port 3 and the longer fourth via 145 in the lower right is electrically connected to port 4. Note that these vias 115, 125, 135, 145 create a horizontal to vertical change in signal path direction. Reflections can arise whenever something interrupts the characteristic impedance of the microwave circuit which is strongly influenced by the geometric relationship between signal conductors and ground conductors, as well as other material characteristics. Here, it is important to note that the signal vias 115, 125, 135, 145 have caused a change in the geometric relationship between the conductors and ground plane 21 over which the microwave signals are traveling. It can be shown that the vias 115, 125, 135, 145 introduce extra inductance per unit length into the circuit 10 and also a discontinuity inductance caused by the abruptly changing the signals' propagations from plane parallel with the circuit board to normal with the board.

Also note the symmetric perpendicular cross shape 800 of the first conductive layer 100 with the initial formation of vertical vias 105 on the perimeter 103 including half arc vias 107 on the arm edges 104 and three quarter vias 108 on the inner corners 106 and one quarter vias on the outer corners 111.

The geometric relationship of the signal lines to the ground plane is important to the performance of the circuit because of characteristic impedance. To completely derive the importance of the signal lines and characteristic impedance relationship is outside the scope of this document, but it can be shown that the characteristic impedance of a transmission line is tightly associated with the differential quantities of inductance and capacitance per unit length. Two measures of microwave signal integrity are reflection and isolation. Reflections distort the signal much the same way as echoes or reverberations distort audio signals. Isolation may be defined as the absence of crosstalk, as when one conversation interrupts another.

Figure 3:
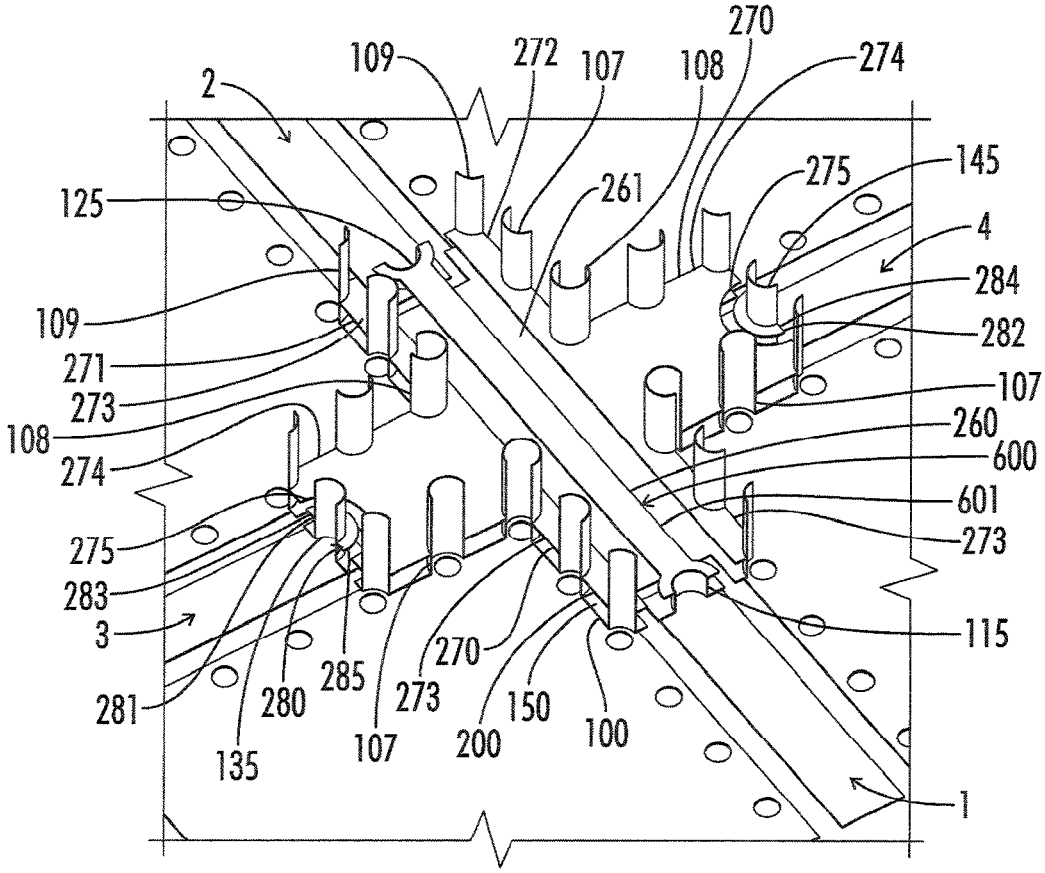
FIG. 3 shows the second metal layer in plane with the first conducting signal layer and the impedance compensating capacitors.

FIG. 3 illustrates the preferred embodiment of the present invention where the second conductive layer 200 is disposed in parallel with the first conductor layer 100 and is separated from it by a dielectric 150. Note that FIG. 3 is rotated in relation to the view shown in FIG. 2 as shown by the position of the ports 1-4. The dielectric 150 can be selected for the application including those known in the art such as air, oil, glass, plastic, ceramic or the like.

The second layer 200 contains three functional elements: a second layer signal line 260 connecting ports 1 & 2, a ground plane 270 and two impedance compensating capacitors 280 shown as the second layer third port capacitor 281 located at port 3 and the second layer fourth port capacitor 282 located at port 4. The second layer signal line 260 is one of the conducting paths 600.

The second layer signal line 260 is connected between the first via 115 and second via 125 to reach down to ports 1 and 2. The second layer signal line 260 extends through the second layer lower line aperture 261 in the second ground plane 270. Note that the second layer signal line 260 is of reduced cross section along the length of the distance between the ports. The ground plane 270 is a conducting plane with a first plane side 271 and second plane side 272 interrupted by the signal line 260. Each mirrored side 271, 272 includes two path edge arms 273 and also includes one capacitor arm 274 with a capacitor aperture 275. Thus, the second ground layer 270 includes two capacitor arms 274, and two capacitor apertures 275. In this manner, each capacitor arm 274 extends to form the first part of the associated impedance compensating capacitor 280.

The impedence compensating capacitor 280 also includes a semicircular extension 285 shown as a half doughnut or half washer shaped conducting structure. The first second layer semicircular extension 283 is electrically connected to the third via 135 and the second second layer semicircular extension 284 is electrically connected to the fourth via 145 reaching down to the associated ports 3 & 4. The conducting doughnut semicircular extension 285 serve to contribute capacitance to the signal vias 135, 145, thus helping to offset the inductance associated with the vertical via presence in the crossover 50.

Also shown in FIG. 3 are the connections of the first ground layer 170 (FIG. 5) connecting half are vias 107, three quarter vias 108, and one quarter vias 109 arranged along the edges of the ground plane 270 of the crossover 50 that connect to the second ground plane 270 to the first ground layer 100. Their purpose is to connect the ground plane 21 to all the ground planes 170 (FIGS. 5 and 6), 270 (FIG. 6), 370 (FIG. 6), 470 (FIGS. 5 and 6), 570 (FIG. 6) of the crossover 50 (FIG. 5). Note how the ground vias 107, 108, 109, and the ground planes 170, 270, 370, 470, 570 they connect are arranged with an external shape of a cross with edges in proximity to the signal lines, and not some other shape. e.g. in the shape of a square or rectangle. This relationship is also important for preserving the proper characteristic impedance and minimizing reflections.

FIG. 4 shows the third conductive layer 300 in parallel with the second conductive layer 200 and separated from the second conductive layer by the dielectric 250. The third conductive layer 300 contains at least one ground plane 370 with two terminating arms 371 and two capacitor arms 374 each defining capacitor apertures 375. The third ground plane 370 is connected by vias 107, 108, 109 to the first ground plane 170 (FIGS. 5 and 6) and the second ground plane 270 (FIGS. 3, 5, and 6).

Each capacitor arm 374 extends to form the first part of the associated third layer impedance compensating capacitor 380 shown as the third layer third port capacitor 381 located at port 3 and the third layer fourth port capacitor 382 located at port 4.

Each impedence compensating capacitor 380 also includes a semicircular extension 385 shown as a half doughnut or half washer shaped conducting structure. The first third layer semicircular extension 383 is electrically connected to the third via 135 and the second third layer semicircular extension 384 is electrically connected to the fourth via 145 reaching down to the associated ports 3 & 4.

Additional conductive layers identical to the construction of the third conductive layer 300 can be added when it is inconvenient to make the conductive of the third conductive layer 300 thick enough. These additional intermediate layers can be crucial to controlling isolation between the signal line connecting ports 1& 2 and the signal line connecting ports 3 & 4. One preferred embodiment uses two conductive layers which are considered to be combined to form the third conductive layer 300.

FIG. 5 illustrates the preferred embodiment of the present invention where the fourth conductive layer 400 is disposed in parallel with the third conductive layer 300 and is separated from it by a third dielectric 350. The fourth layer 400 contains two functional elements: a fourth layer signal line 460 connecting ports 3 & 4 and a ground plane 470. The fourth layer signal line 460 is also one of the conducting paths 600.

The signal line 460 is connected between the third via 135 and fourth via 145 to reach down to ports 3 and 4. Note that the signal line is also of reduced cross section along the length of the distance between the ports.

The ground plane 470 is a conducting plane with a first plane side 471 and second plane side 472 interrupted by the signal line 460. Each mirrored side 471, 472 includes two path edge arms 473 and also includes one terminating arm 474.

Also shown in FIG. 5 are the connections of the first ground layer 170 connecting half arc vias 107, three quarter are vias 108, and one quarter arc vias 109 arranged along the edges of the ground plane 470 of the crossover 50 (FIGS. 2, 5, and 6) that connect to the fourth ground plane 470 to the first ground plane 170).

FIG. 6 shows the fifth conductive layer 500 that is disposed in parallel with the fourth conductive layer 400 and is separated from it by a fourth dielectric 450. The filth conductive layer 500 is continuous and is very similar to the first body 102. The fifth conductive layer 500 forms a ground layer 570 with terminating arms 574 connected by the half arc vias 107, three quarter vias 108, and one quarter arc vias 109 arranged along the edges of the ground plane 570 of the crossover 50 that connect the fifth ground plane 570 to the other ground planes 170, 270, 370, 470.

Figure 7:
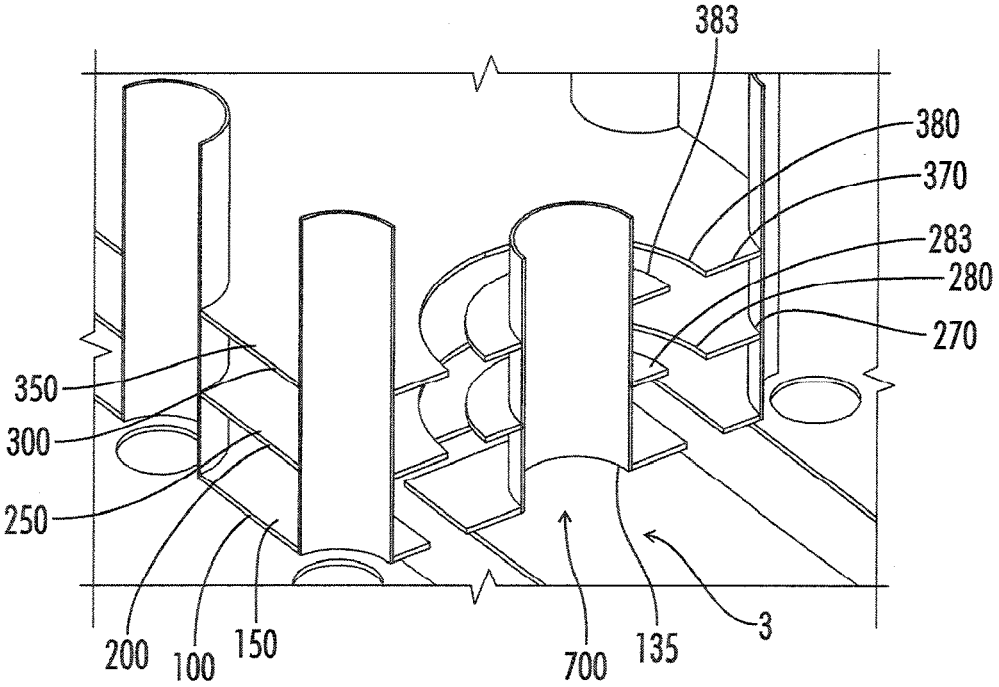
FIG. 7 is a magnified view of the synthetic transmission line created by the shunt capacitors at each metal layer through which a signal via travels.

FIG. 7 shows the synthetic transmission line 700 is created by adding shunt capacitors to each conductive layer through which a signal via travels and is created by the above described structure. The synthetic transmission line 700 shown is at port 3. The connecting via 135 vertically traverses the second and third conductive layers 200, 300 and dielectric layers 150, 250, 350 which behave as inductive discontinuities to the signals intended to travel between ports 1 & 2 (in FIG. 2) and between ports 3 & 4 (in FIG. 2). In order to minimize these inductive discontinuities, capacitors 280, 380 have been formed between the signal via 135 and ground planes 200, 300. This creates a ladder network of series inductances and shunt capacitances, forming a so-called synthetic transmission line 700. By adding shunt capacitance to each layer 200, 300 in the form of washer or doughnut-shaped conducting features 283, 284 (in FIG. 3), 383, 384 (in FIG. 4) aligned in coplanarity with ground plane layers 270, 370 and as shown in FIG. 7, signal reflections from ports 1-4 (in FIG. 2) are greatly reduced.

As noted throughout the exterior crossover perimeter shapes of FIGS. 1 through 6, a cut-off waveguide 800 (FIG.

6) is created by the cross arm shape of the crossover 50. As shown in FIGS. 2-6, the body of the crossover 50 is shaped like a cross with extending arms. In the absence of any other surface mount device with which to compare this structure that might seem like a normal shape or perhaps a whim of the designer, but this is not the case. Most all surface-mount microwave components are rectangular or square. The tacit but widespread assumption that microwave surface-mount components should be square is subtly reinforced today in the computer-aided design software used to create the components, because they begin with a 'box' that may be either rectangular or square. Thus, creating a surface-mount microwave component that is not square is not only not obvious to the competent practitioner, it is also not convenient. But there is a physical reason why a designer might want to shape a crossover this way, namely to attenuate higher order waveguide modes. Although beyond the scope of this disclosure, it can be shown that electromagnetic energy can propagate not only along signal traces, but also inside structures known as 'waveguide' which may be made of conductive, conductive plus dielectric or just dielectric. An example of a dielectric waveguide is an optical fiber, which propagates electromagnetic energy in the form of light. Moreover, it is very evident that electromagnetic energy may propagate through free space, because otherwise radios could not physically exist. By making the signal/ground structures of the crossover narrow and creating the intersection of two narrow structures, with signal lines on different isolated geometric planes, isolation is improved. Thus, the present invention teaches unique construction method and apparatus not previously known.

Reference numerals used throughout the detailed description and the drawings correspond to the following elements:

first port 1
second port 2
third port 3
fourth port 4
base microwave circuit 10
first signal line 11
second signal line 12
third signal line 13
fourth signal line 14
plated through hole vias 16
common ground plane 21
microwave crossover 50
first conductive layer 100
first layer body 102
perimeter 103
arm edges 104
vertical vias 105
inner corners 106
half arc vias 107
three quarter vias 108
one quarter vias 109
first arm 110
outer corners 111
first transition end 112
first half circle arc transition aperture 113
first via transfer 114
first ground fingers 116, 118
first signal via 115
second arm 120
second transition end 122
second half circle arc transition aperture 123
second via transfer 124
second ground fingers 126, 128
second signal via 125
third arm 130
third transition end 132
third half circle arc transition aperture 133
third via transfer 134
third ground fingers 136, 138
third signal via 135
fourth arm 140
fourth transition end 142
fourth half circle arc transition aperture 143
fourth via transfer 144
fourth ground fingers 146, 148
fourth signal via 145
center body 149
dielectric 150
first layer ground plane 170
second conductive layer 200
second dielectric 250
lower signal line 260
lower line aperture 261
second ground plane 270
first plane side 271
second plane side 272
path edge arms 273
capacitor arm 274
capacitor apertures 275
impedance compensating capacitor 280
second layer third port capacitor 281
second layer fourth port capacitor 282
impedance compensating capacitor 280
first second layer semicircular extension 283
second second layer semicircular extension 284
semicircular extensions 285
third conductive layer 300
third conductive layer 300
third dielectric 350
third ground plane 370
third layer terminating arms 371
third layer capacitor arms 374
third layer capacitor apertures 375
third layer impedance compensating capacitor 380
third layer fourth port capacitor 382
first third layer semicircular extension 383
second third layer semicircular extension 384
semicircular extension 385
fourth conductive layer 400
fourth dielectric 450
upper signal line 460
upper line aperture 461
fourth ground plane 470
first plane side 471
second plane side 472
path edge arms 473
terminating arm 474
fifth conductive layer 500
fifth ground layer 570
fifth layer terminating arms 574
shielded paths 600
first path 601
second path 602
synthetic transmission line 700
cut-off waveguide 800

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A signal path crossover apparatus to transfer a signal on a circuit board including a first port, a second port, and a board ground; the signal path crossover comprising:

at least one vertical via;

a first conductive layer including a first ground layer electrically connected to the at least one vertical via;

a first dielectric layer positioned adjacent to the first conductive layer;

a second conductive layer including a signal path connected to the first port and the second part, and a second ground layer electrically connected to the at least one vertical via;

a second dielectric layer positioned adjacent to the second conductive layer;

a third conductive layer including a third ground layer electrically connected to the at least one vertical via;

the at least one vertical via electrically connecting all three of the first ground layer, the second ground layer, and the third ground layer to the board ground, the at least one vertical via including at least one outer corner one quarter arc via, at least one half arc shaped via, and at least one a three quarter arc via positioned adjacent to the first conductive layer.

2. A signal path crossover apparatus to transfer a signal on a circuit board including a first port a second port, and a board ground; the signal path crossover comprising:

at least one vertical via;

a first conductive layer including a first ground layer electrically connected to the at least one vertical via;

a first dielectric layer positioned adjacent to the first conductive layer;

a second conductive layer including a signal path connected to the first port and the second port, and a second ground layer electrically connected to the at least one vertical via;

a second dielectric layer positioned adjacent to the second conductive layer;

a third conductive layer including a third ground layer electrically connected to the at least one vertical via;

the at least one vertical via electrically connecting the first ground layer, the second ground layer, and the third ground layer to the board ground the at least one vertical via including at least one outer corner one quarter arc via and a half arc shaped via positioned adjacent to the first conductive layer, the first conductive layer physically bonded to the board ground.

3. The apparatus of claim 2, the first conductive layer defining at least one half circle arc transition aperture.

4. The apparatus of claim 2, the second conductive layer defining a line aperture.

5. The apparatus of claim 2, the third conductive layer defining at least one capacitor aperture.

6. The apparatus of claim 2, the third conductive layer including terminating arms.

7. A signal path crossover apparatus to transfer a signal on a circuit board including a first port, a second port, a third port, a fourth port, and a board ground; the signal path crossover comprising:

at least one vertical via;

a first conductive layer including a first ground layer electrically connected to the at least one vertical via;

a first dielectric layer positioned adjacent to the first conductive layer;

a second conductive layer including a signal path connected to the first port and the second port, and a second ground layer electrically connected to the at least one vertical via;

a second dielectric layer positioned adjacent to the second conductive layer;

a third conductive layer including a third ground layer electrically connected to the at least one vertical via;

a third dielectric layer positioned adjacent to the third conductive layer;

a fourth conductive layer including a signal path connected to the third port and the fourth port, and a fourth ground layer electrically connected to the at least one vertical via;

a fourth dielectric layer positioned adjacent to the fourth conductive layer;

a fifth conductive layer including a fifth ground layer electrically connected to the at least one vertical via;

the at least one vertical via electrically connecting the first ground layer, the second ground layer the third ground layer, the fourth ground layer, and the fifth ground layer to the board ground, the at least one vertical via including at least one outer corner one quarter are via and a half arc shaped via positioned adjacent to the first conductive layer, the fourth conductive layer defining a line aperture.

8. The apparatus of claim 7, the fourth conductive layer including terminating arms.

9. The apparatus of claim 7, the fifth conductive layer including terminating arms.

* * * * *